United States Patent [19]

Barnett et al.

[11] Patent Number: 4,895,622

[45] Date of Patent: Jan. 23, 1990

[54] PRESS FELT CONDITIONER FOR NEUTRAL AND ALKALINE PAPERMAKING SYSTEMS

[75] Inventors: Daniel J. Barnett; Abdul Q. Khan; Patricia R. Keen, all of Jacksonville, Fla.

[73] Assignee: Betz Laboratories, Inc., Trevose, Pa.

[21] Appl. No.: 269,218

[22] Filed: Nov. 9, 1988

[51] Int. Cl.[4] ..... D21F 1/32

[52] U.S. Cl. ..... 162/199; 162/DIG. 4; 162/72

[58] Field of Search ..... 162/199, DIG. 4, 72

[56] References Cited

U.S. PATENT DOCUMENTS

| | | | |
|---|---|---|---|
| 3,071,504 | 1/1963 | Dunklin et al. | 162/199 |
| 3,398,047 | 8/1968 | Michalski | 162/199 |
| 3,573,089 | 3/1971 | Tate | 162/199 |
| 3,873,417 | 3/1975 | Otrhalek et al. | 162/199 |
| 3,992,249 | 11/1976 | Farley | 162/199 |
| 4,184,912 | 1/1980 | Payton | 162/199 |
| 4,715,931 | 12/1987 | Schellhamer et al. | 162/199 |

OTHER PUBLICATIONS

Casey, Pulp and Paper–Chemistry and Chemical Technology, 3rd Edition, vol. II; 1980; pp 1084–1087.

*Primary Examiner*—Peter Chin
*Assistant Examiner*—Thi Dang
*Attorney, Agent, or Firm*—Alexander D. Ricci; Steven D. Boyd

[57] ABSTRACT

This invention relates to an improved press felt conditioning treatment which controls the deposition of polymerically flocculated particulate substances in a press felt. The treatment comprises applying to the felt an effective inhibiting amount of a conditioner comprising a relatively low molecular weight organic, anionic polymer and at least one hydrophilic, nonionic or anionic surfactant. The polymer preferrably has an acrylic acid or methacrylic acid functionality and is preferrably selected from the group consisting of homopolymers of acrylic acid, a methacrylic acid/polyethylene glycol allyl ether copolymer, a homopolymer of methacrylic acid, an acrylic acid/polyethylene glycol allyl ether copolymer, and an acrylic acid/1-allyloxy-2-hydroxypropane sulfonic acid copolymer. The surfactant is preferrably selected from the group consisting of octyl phenol ethoxylate, nonyl phenol ethoxylate, dodecyl phenol ethoxylate, secondary alcohol ethoxylate, ethoxylated polyoxypropylene glycol, dialkyl phenol ethoxylate, alkyl polyglycoside, dodecylbenzene sulfonic acid and polyoxyethyelene sorbitan monoester. The use of a relatively low molecular weight polymer having an acrylic acid or methacrylic acid functionality in combination with at least one hydrophilic, nonionic or anionic surfactant is especially effective at preventing the deposition of polymerically flocculated particulate substances in a press felt and papermaking machine.

15 Claims, No Drawings

PRESS FELT CONDITIONER FOR NEUTRAL AND ALKALINE PAPERMAKING SYSTEMS

BACKGROUND OF THE INVENTION

1. Field of the Invention

The present invention relates to inhibiting the deposition of particulate materials in the felts of a papermaking system. More particularly, the present invention relates to a press felt conditioner which controls the deposition of polymerically flocculated particulate materials in nonacidic papermaking systems.

2. Description of the Prior Art

In a paper manufacturing process, ionically charged, relatively high molecular weight, water soluble polymers are often employed to enhance retention of cellulosic fibers, fines, and inorganic fillers. The addition of these polymers produces a cleaner process stream by reducing the solids level in the process filtrate. The high molecular weight, ionically, charged polymers control solids by adsorbing onto solid particulate surfaces in the papermaking furnish slurry and invoking charge neutralization (coagulation) and/or bridging (flocculation) mechanisms which cause the solid particles to flocculate. The flocculate can be retained by the formed mat of cellulosic fibers more easily than smaller individual particles. However, these flocculated particulate materials can be transferred from the surface of the sheet to the papermachine press felts. In the flocculated state, the particles cannot pass through the fine, porous structure of the press felt and become entrapped therein. If not controlled by adequate felt conditioning practices, these agglomerated particulate substances can severely impair the ability of the press felts to absorb water thereby requiring reduced production rates and shortening the useful life of the felts. In addition, it has been found that common polymeric retention aids can render normally effective prior art felt conditioners useless or marginally effective.

Typical polymers employed as retention aids are generally relatively high in molecular weight; for example, copolymers made from monomers such as; acrylic acid, acrylamide, dimethyl/diallyl ammonium chloride, dimethylamine, epichlorohydrin, and ethylenediamine. Typically, polymeric retention aids have average molecular weights greater than 1,000,000 and can range up to around 20,000,000 for anionically charged polymers and up to 15,000,000 for cationically charged polymers. These ionically charged polymers adsorb onto the various solid particulate surfaces within the papermaking furnish causing flocculation.

In neutral and alkaline papermaking (pH from approximately 6–8.5) the use of polymeric retention aids is particularly critical for efficient operation. Without the use of such retention aids, common system additives such as cellulose-reactive sizes can cycle up in the process system and hydrolyze causing system upsets. As a result, in most neutral and alkaline papermaking systems most of the particulate contaminants that are transferred from the sheet to the press felt are flocculated. Such flocculated particles are relatively unresponsive to typical felt conditioning treatments.

Analysis of used press felts from neutral and alkaline papermaking systems reveal a number of polymerically flocculated materials. Significant quantities of inorganic fillers such as; calcium carbonate, clay, and titanium dioxide alone or in association with particles of latex coating binders such as, polyvinyl acetate or styrenebutadiene rubber are found. Other types of contaminants that can be associated with the agglomerates, in significantly lower quantities, can include starches, natural wood pitch (fatty esters, fatty and resin acids/salts) cellulosic fiber fines, microbiological contaminants and absorbants, such as talc or bentonite, oil-based defoamers and insoluble metal hydroxides. All of these contaminants can be present to some degree based on a variety of factors, such as, the wood fiber and water sources, time of year, grade of material produced, type and quantity of system additives, pulp production methods and equipment designs and capacities.

Processes to inhibit contamination deposition in papermaking felts are known in the art. U.S. Pat. No. 4,715,931, Schellhamer et al. discloses a process for inhibiting aluminum hydroxide deposition in papermaking systems which comprises adding to the felts a hydroxylated carboxylic acid. The use of the carboxylic acid in combination with surfactants, such as octyl phenol ethoxylates, nonyl phenol ethoxylates and others listed therein inhibit aluminum hydroxide deposition and associated organic contaminants.

In addition to the control of inorganic contaminants, pitch formation is of concern in papermaking systems. Filler materials can become trapped within the organic matrix formed by pitch coalescence compounding deposition problems. Methods of controlling the pitch deposition formation are known in the art, U.S. Pat. No. 4,184,912, Payton, discloses a method of preventing pitch formation by dispersing and emulsifying pitch particles in the pulp furnish to an exceptionally fine state and uniformally distributing the particles throughout the finished paper. The pitch deposition is controlled by the addition of a three component formulation comprising a nonionic surfactant plus an anionic surfactant and a low molecular weight anionic polymer. The three component mixture is added to the papermaking pulp system at a point prior to where pitch deposits normally form. In U.S. Pat. No. 3,992,249, Farley, a process for inhibiting pitch deposition is disclosed wherein the pulp is washed with an aqueous solution of anionic polymer having between 25 to 85 mole percent hydrophobic-oleophilic linkages and 15 to 70 mole percent hydrophilic acid linkages to complex with the pitch. The pitch-polymer complex is washed away with water.

U.S. Pat. No. 3,873,417, Otrhalek et al., discloses a pitch and pigment dispersant which comprises a neutralized solution of polymer prepared by free radical polymerization of an alpha, beta unsaturated acid with an alkyl ester and an allyl alcohol.

SUMMARY OF INVENTION

The present invention relates to an improved press felt conditioning treatment which controls the deposition of polymerically flocculated particulate substances in a press felt. More particularly, the present invention relates to the use of members of a class of relatively low molecular weight, organic anionic polymers in combination with hydrophilic nonionic or anionic surfactants to control the deposition of polymerically flocculated particulates in press felts under nonacidic conditions.

The felt conditioners of the present invention are preferrably applied by metering into 1 or more fresh water showers directed onto a press felt between the press nip and the vacuum or uhle box utilized for dewatering the felt. The combination of the relatively low molecular weight, organic anionic polymers with hydrophilic nonionic or anionic surfactants has been found to produce felt conditioning effectiveness which is unexpected based upon the conditioning effects of the individual components.

Unexpected and surprising press felt conditioning results, with respect to polymerically flocculated particulates, have been discovered when relatively low molecular weight organic anionic polymers and at least one hydrophilic nonionic or anionic surfactant are employed. The polymer is preferrably selected from a group comprised of homopolymers of acrylic acid, copolymers of methacrylic acid and polyethylene glycol allyl ether, homopolymers of methacrylic acid, copolymers of acrylic acid and polyethylene glycol allyl ether and copolymers of acrylic acid and 1-allyloxy-2-hydroxy propane sulfonic acid. The above polymers are employed in combination with one or more hydrophilic nonionic or anionic surfactants such as, octyl phenol ethoxylate, nonyl phenyl ethoxylate, dodecyl phenol ethoxylate, secondary alcohol ethoxylate, ethoxylated polyoxypropylene glycol, dialkyl phenol ethoxylate, alkyl polyglycoside, dodecyl benzene sulfonic acid, and polyoxyethylene sorbitan monoester.

The use of these relatively low molecular weight anionic polymers in combination with the hydrophilic surfactants known in the art for controlling organic felt contaminants such as pitch components or rosin size provides an unexpectedly effective felt conditioning treatment for controlling deposition of polymerically flocculated particulate substances in a papermaking press felt.

DESCRIPTION OF THE PREFERRED EMBODIMENTS

The present invention relates to a process for inhibiting the deposition of polymerically flocculated particulates in a felt in a press section of the papermaking system wherein the felt is prone to such deposition. The press felt conditioner of the present invention is typically applied to the press felt in an aqueous shower. The felt conditioner of the present invention comprises an effective inhibiting amount of a mixture of a relatively low molecular weight anionic organic polymer and a hydrophilic anionic or nonionic surfactant. It has been found that an unexpected effectiveness in controlling the deposition of polymerically flocculated particulates is provided by the specific combination of the present invention. The relatively low molecular weight polymer of the present invention preferrably has an average molecular weight of from about 5,000 to 200,000 as described in more detail below.

The organic polymers of the present invention are preferrably those polymers or copolymers which have acrylic acid or methacrylic acid functionality. Exemplary polymers include: homopolymers of acrylic acid having an average molecular weight from about 5,000 to about 200,000; copolymers of methacrylic acid and polyethylene glycol allyl ether having average molecular weights of from about 5,000 to about 7,000; homopolymers of methacrylic acid having an average molecular weight of about 15,000; copolymers of acrylic acid and polyethylene glycol allyl ether having an average molecular weight of from about 5,000 to about 7,000; and copolymers of acrylic acid and 1-allyloxy-2-hydroxypropane sulfonic acid having an average molecular weight of about 32,000.

The polymers of the present invention are a limited class of compounds which have acrylic acid or methacrylic acid functionality and which provide unexpected efficacy in inhibiting polymerically flocculated particulate deposition when combined with a surfactant described below. It is believed that the acrylic acid or methacrylic acid functionality in combination with the hydrophilic surfactant redisperses the high molecular weight polymerically flocculated contaminants and emulsifies or wets out the individual contaminant components allowing them to pass through the fine pore structure of the press felts. The hydrophilic surfactants of the present invention which have been found to provide unexpected efficacy when combined with the above polymers in a felt conditioning spray include:

octyl phenol ethoxylates: $C_8H_{17}—C_6H_4—O—(CH_2CH_2O)_{n-1}CH_2CH_2OH$ where n=9–30;

nonyl phenol ethoxylates: $C_9H_{19}—C_6H_4—O—(CH_2CH_2O)_{n-1}CH_2CH_2OH$ where n=9–40;

dodecyl phenol ethoxylates: $C_{12}H_{25}—C_6H_4—O—(CH_2CH_2O)_{n-1}CH_2CH_2OH$ where n=9–40;

primary alcohol ethoxylates: $CH_3—(CH_2)_{x-C}H_2O(CH_2CH_2O)_{n-1}CH_2CH_2OH$ where n=12–30 and x=10–13;

secondary alcohol ethoxylates:

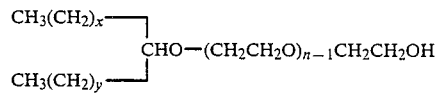

where n=12–30, x=9–12 and y=9–12;

ethoxylated polyoxypropylene glycols:

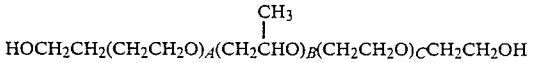

where A=C=1,300–15,000 molecular weight and possibly greater, and B=2,000–5,000 molecular weight and possibly greater;

dialkyl phenol ethoxylates:

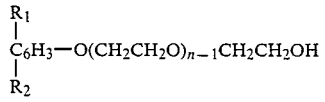

where n=9–40, $R_1=C_8H_{17}$, $C_9H_{19}$ or $C_{12}H_{25}$ and $R_2=C_8H_{17}$, $C_9H_{19}$ or $C_{12}H_{25}$;

polyoxyethylene sorbitan monester:

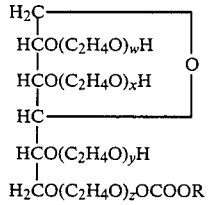

where $x+y+w+z=10$–30 and R=lauric, palmitic, stearic or oleic., linear alkybenzene sulfonic acids:

$R—C_6H_4—SO_3X$ where $r = C_8H_{17}$, $C_9H_{19}$ or $C_{12}H_{25}$ and x=H, Na, K, $NH_4$, etc.;

alkyl polyglycoside:

$$C_nH_{2n+1}O(C_6H_{10}O_5)xH$$

where n=1–15 and x=1–10.

The combination of the above described acrylic acid or methacrylic acid based homopolymers or copolymers with one or more of the above described hydrophilic surfactants in the preferred range of from 2:1 to 1:4 has been found to provide effective continuous press felt conditioning treatment when the press felt is subjected to contamination by polymerically flocculated contaminants encountered in alkaline and neutral papermaking process systems. It is also believed that the combination of the present invention can be used effectively to prevent the same type of contaminants from building up on the papermachine press section press rolls when fed to an aqueous shower directed upon the press rolls.

The amount or concentration of the combination of the present invention employed can vary dependent upon, among other things, the volume of the shower water employed, the paper production rate, and the concentration of the polymerically flocculated contaminants. Generally, the total concentration of the combination added to the aqueous shower medium will range from about 10 to about 1500 parts per million parts of aqueous medium. Preferrably, the combination is added at a concentration of from about 100 to about 300 parts per million parts of the aqueous showering medium.

In order to more clearly illustrate the present invention the following data was developed. The following examples were included as illustrations of the present invention and should not be construed as limiting the scope thereof.

EXAMPLES

The examples contained herein demonstrate the unexpected efficacy of the combination of the present invention. The data was obtained utilizing a continuous press felt conditioning test apparatus and a simulated alkaline fine paper contaminant system. The testing incorporated a clean (unused) press felt sample of known initial weight and air permeability placed on a heavy-mesh support screen through which the treated or untreated contaminant solution was pressed.

The simulated alkaline papemaking white water contaminant test slurry consisted of the following:

| Ingredient | Concentration (ppm) |
|---|---|
| Ground Calcium Carbonate | 525 |
| Titanium Dioxide | 75 |
| Clay | 150 |
| Alkaline Size (ASA/Starch,1:3 ratio, 15% slurry) | 75 |
| Cationic Retention Aid (High Molecular Weight Polyacrylamide - approximately 7.5 cationic mole %, approximately 6 million molecular weight) | 1 |
| Calcium Chloride | 100 (as Ca) |

Table 1 contains data generated with the above test system to compare the performance characteristics of a number of commercially available surfactants and low molecular weight anionic polymers. As can be seen from Table 1, the individual components were tested and the percent weight gain and percent permeability decrease of the test felt measured. Thereafter, a series of dual component treatments (surfactant and anionic polymers) were tested. As shown, when an acrylic acid or methacrylic acid-based polymer is employed in combination with a hydrophilic surfactant, there is an unexpected improvement in felt conditioning based upon the effectiveness of the individual components. When a nonacrylic acid or nonmethacrylic acid polymer is employed in combination with a hydrophilic surfactant, the unexpected improvement is not found.

TABLE 1

Performance of various example surfactants and low molecular weight anionic polymers alone and in combination in a felt conditioning test system utilizing a simulated polymerically flocculated alkaline fine paper felt contaminant system.

| Conditioning Agent | Treatment Concentration (ppm) | % Weight Gain of Test Felt (over clean control) | % Permeability Decrease of Test Felt (from clean control) |
|---|---|---|---|
| (Untreated Control) | | 11.68 | 52.56 |
| Single Component Treatments: | | (Low Molecular Weight Anionic Polymers) | |
| Polyacrylic acid (A) | 300 | 11.65 | 46.17 |
| " | 150 | 12.58 | 48.87 |
| Polyacrylic acid (B) | 300 | 24.87 | 77.80 |
| Polymethacrylic acid | 90 | 13.12 | 53.0 |
| Polymethacrylic acid Polyethylene glycol allyl ether | 90 | 11.54 | 45.90 |
| Polyacrylic acid polyethylene glycol allyl ether | 300 | 11.46 | 50.0 |
| Polyacrylic acid 1-allyloxy-2-hydroxy propane sulfonic acid | 90 | 14.03 | 46.0 |
| Polymaleic acid | 150 | 11.01 | 46.23 |
| Lignosulfonate | 300 | 22.84 | 69.00 |
| Di-isobutylene maleic anhydride copolymer | 300 | 13.83 | 42.10 |
| Single Component Treatments: | | (Surfactants) | |
| Octyl phenol ethoxylate | 300 | 12.34 | 37.80 |
| Nonyl phenol ethoxylate | 300 | 12.24 | 44.70 |
| Dodecyl phenol ethoxylate | 300 | 11.09 | 41.50 |

TABLE 1-continued

Performance of various example surfactants and low molecular weight anionic polymers alone and in combination in a felt conditioning test system utilizing a simulated polymerically flocculated alkaline fine paper felt contaminant system.

| Conditioning Agent | Treatment Concentration (ppm) | % Weight Gain of Test Felt (over clean control) | % Permeability Decrease of Test Felt (from clean control) |
|---|---|---|---|
| Dialkyl phenol ethoxylate | 300 | 11.49 | 40.30 |
| Secondary alcohol ethoxylate | 300 | 11.61 | 40.70 |
| Ethoxylated poly-oxypropylene glycol | 300 | 11.94 | 51.00 |
| Alkyl polyglycoside | 300 | 12.35 | 48.43 |
| Dodecyl benzene sulfonic acid | 300 | 14.31 | 45.20 |
| Polyoxyethylene sorbitan monoester | 300 | 10.34 | 46.0 |
| Dual-Component Treatments: | (Low Molecular Weight Anionic Polymers/Surfactants) | | |
| Polyacrylic acid (A)/ octyl phenol ethoxylate | 75/150 | 7.80 | 25.10 |
| Polyacrylic acid (A)/ nonyl phenol ethoxylate | 75/150<br>150/150 | 6.56<br>7.63 | 31.35<br>23.64 |
| Polyacrylic acid (A)/ dodecyl phenol ethoxylate | 75/150 | 5.47 | 34.30 |
| Polyacrylic acid (A)/ dialkyl phenol ethoxylate | 75/150 | 9.80 | 38.64 |
| Polyacrylic acid (A)/ secondary alcohol ethoxylate | 150/150 | 7.74 | 32.30 |
| Polyacrylic acid (A)/ ethoxylated poly-oxypropylene glycol | 75/150 | 8.29 | 46.40 |
| Polyacrylic acid (A)/ alkyl polyglycoside | 75/150 | 10.50 | 38.20 |
| Polyacrylic acid (A)/ dodecyl benzene sulfonic acid | 75/150 | 8.24 | 32.40 |
| Polyacrylic acid (A)/ polyoxyethylene sorbitan monoester | 150/150 | 9.82 | 40.90 |
| Polyacrylic acid (B)/ nonyl phenol ethoxylate | 150/150 | 10.53 | 34.50 |
| Polymethacrylic acid/ nonyl phenol ehoxylate | 45/150 | 7.70 | 36.30 |
| Polymethacrylic acid/ polyethylene glycol allyl ether/nonyl phenol ethoxylate | 45/150 | 7.70 | 36.30 |
| Polyacrylic acid polyethylene glycol allyl ether/polyethylene sorbitan monoester | 150/150 | 8.10 | 34.70 |
| Polyacrylic acid 1-allyloxy-2-hydroxy propane sulfonic acid/ secondary alcohol ethoxylate | 45/150 | 9.18 | 46.0 |
| Dual-Components Treatments: | | | |
| Polymaleic acid/ alkyl polyglycoside | 75/150 | 11.74 | 46.23 |
| Lignosulfonate/ nonyl phenol ethoxylate | 18.00 | 54.22 | |
| Polyacrylic acid (A)/ di-isobutylene maleic anhydride copolymer | 75/150 | 12.07 | 42.40 |

Tables 2 and 3 summarize data generated to evaluate the effectiveness of the present invention when the polymeric retention aid which is employed to flocculate contaminants is either anionic (Table 2) or cationic (Table 3).

The data in both Tables 2 and 3 was generated with a total filler concentration held constant at 750 parts per million (525 parts per million $CaCO_3$, 75 parts per million $TiO_2$, 150 parts per million clay) while the ASA/-starch concentration was varied relative to the filler content. In Table 2, 0.5 ppm, based on contaminant slurry volume of a high molecular weight anionic retention aid in conjunction with precipitated calcium carbonate was used. In Table 3, 1.0 ppm, based on contaminant slurry volume, of a high molecular weight cationic retention aid was employed.

TABLE 2

EFFECT OF ASA/STARCH CONCENTRATION ON PRECIPITATED $CaCO_3$ - ANIONIC RETENTION AID(1) SYSTEM

| ASA/STARCH: Filler Ratio | Control % Wt. Gain | Control % CFM Loss | Nonyl phenol Ethoxylate (300 ppm) % Wt. Gain | Nonyl phenol Ethoxylate (300 ppm) % CFM Loss | Polyacrylic Acid (150 ppm) % Wt. Gain | Polyacrylic Acid (150 ppm) % CFM Loss | Nonyl phenol ethoxylate/ Polyacrylic Acid (150 ppm/75 ppm) % Wt. Gain | Nonyl phenol ethoxylate/ Polyacrylic Acid (150 ppm/75 ppm) % CFM Loss |
|---|---|---|---|---|---|---|---|---|
| 0.2:1 | 13.11 | 50.53 | 5.83 | 25.26 | 5.01 | 27.86 | 2.55 | 22.76 |
| 0.02:1 | 21.85 | 83.59 | 19.90 | 76.36 | 17.07 | 58.44 | 6.10 | 23.53 |
| 0.01:1 | 18.85 | 82.55 | 20.57 | 74.55 | 17.59 | 57.70 | 12.56 | 35.33 |
| 0:1 | 11.27 | 46.82 | 11.75 | 41.51 | 5.33 | 25.53 | 0.42 | 14.41 |

(1) Copolymer of Acylamide/Acrylic Acid
Anionic mole % = 30
Molecular weight = 15 MM

TABLE

EFFECT OF ASA/STARCH CONCENTRATION ON GROUND $CaCO_3$ - CATIONIC RETENTION AID(2) SYSTEM

| ASA/STARCH: Filler Ratio | Control % Wt. Gain | Control % CFM Loss | nonyl phenol Ethoxylate (300 ppm) % Wt. Gain | nonyl phenol Ethoxylate (300 ppm) % CFM Loss | Polyacrylic Acid (150 ppm) % Wt. Gain | Polyacrylic Acid (150 ppm) % CFM Loss | Nonyl phenol ethoxylate/ Polyacrylic Acid (150 ppm/75 ppm) % Wt. Gain | Nonyl phenol ethoxylate/ Polyacrylic Acid (150 ppm/75 ppm) %CFM Loss |
|---|---|---|---|---|---|---|---|---|
| 0.1:1 | 12.33 | 54.02 | 12.24 | 44.70 | 12.58 | 48.87 | 6.56 | 31.35 |
| 0.02:1 | 20.38 | 60.04 | 15.76 | 57.82 | 15.65 | 55.03 | 10.60 | 34.50 |

(2) Copolymer of ETAC/Acrylamide
Cationic mole % = 7.5
Molecular weight = 6 MM

As can be seen in Tables 2 and 3, the combination of the present invention provides positive felt conditioning regardless of whether the felt contaminants are flocculated with a cationic or anionic retention aid.

While this invention has been described with respect to particular embodiments thereof, it is apparent that numerous other forms and modifications of the invention will be obvious to those skilled in the art. The appended claims and this invention should be construed to cover all such obvious forms and modifications which are within the true spirit and scope of the present invention.

What is claimed is:

1. A process for inhibiting polymeric retention aid flocculated particulate deposition in felts of a papermaking system which comprises applying to said felts an effective inhibiting amount of a felt conditioner consisting essentially of:

a. A relatively low molecular weight organic, anionic polymer selected from the group consisting of: homopolymers of acrylic acid; copolymers of methacrylic acid and polyethylene glycol allyl ether; homopolymers of methacrylic acid; copolymers of acrylic acid and polyethylene glycol allyl ether; copolymers of acrylic acid and 1-allyloxy-2-hydroxypropane sulfonic acid; and b. At least one hydrophilic, nonionic or anionic surfactant selected from the group consisting of: octyl phenol ethoxylate, nonyl phenol ethoxylate dodecyl phenol ethoxylate, secondary alcohol ethoxylate, ethoxylated polyoxypropylene glycol, dialkyl phenol ethoxylate, alkyl polyglycoside, dodecylbenzene sulfonic acid, and polyoxyethylene sorbitan monoester.

2. The process of claim 1 wherein the ratio of said polymer to said surfactant is from about 2:1 to about 1:4.

3. The process of claim 1 wherein said papermaking system is a neutral or alkaline system.

4. The process of claim 5 wherein the pH of said system is from 6 to about 8.5.

5. The process of claim 1 wherein said felt is conditioned by showering with an aqueous medium including said felt conditioner.

6. The process of claim 7 wherein said felt conditioner is added in an amount from about 10 to about 1,500 parts per million parts of said aqueous medium.

7. The process of claim 8 wherein said felt conditioner is added in amount from about 100 to about 300 parts per million parts said aqueous medium.

8. A method of inhibiting deposition of polymeric retention aid flocculated particulates in a press section of a papermaking system wherein the felt is prone to such deposition and the felt is conditioned by showering with an aqueous medium which comprises adding to said aqueous medium an effective inhibiting amount of a felt conditioner consisting essentially of:

a. A relatively low molecular weight organic anionic polymer selected from the group consisting of: homopolymers of acrylic acid; copolymers of methacrylic acid and polyethylene glycol allyl ether; homopolymers of methacrylic acid; copolymers of acrylic acid and polyethylene glycol allyl ether; and copolymers of acrylic acid and 1-allyloxy-2-hydroxypropane sulfonic acid; and b. At least one hydrophilic nonionic or anionic surfactant selected from the group consisting of: octyl phenol ethoxylate, nonyl phenol ethoxylate, dodecyl phenol ethoxylate, secondary alcohol ethoxylate, ethoxylated polyoxypropylene glycol, dialkyl phenol ethoxylate, alkyl polyglycoside, dodecylbenzene sulfonic acid, and polyoxyethylene sorbitan monoester.

9. The process of claim 8 wherein the ratio of said polymer to said surfactant is from about 2:1 to about 1:4.

10. The method of claim 8 wherein said papermaking system is a neutral or alkaline papermaking system.

11. The method of claim 10 wherein the pH of said system is from about 6 to 8.5.

12. The method of claim 8 wherein said felt conditioner is added in an amount from about 10 to about 1500 parts per million parts said aqueous medium.

13. The method of claim 8 wherein said felt conditioner is added in an amount of from about 100 to 300 parts per million parts of said aqueous medium.

14. In a process for conditioning of a press felt in a papermaking system providing paper or paperboard from pulp suspensions containing polymeric retention aid flocculated particles wherein said flocculated particles are depositing in said felt and a surfactant selected from the group consisting of: octyl phenol ethoxylate, nonyl phenol ethoxylate, dodecyl phenol ethoxylate, secondary alcohol ethoxylate, ethoxylated polyoxypropylene glycol, dialkyl phenol ethoxylate, alkyl polyglycoside, dodecylbenzene sulfonic acid, and polyoxyethylene sorbitan monoester is added to the shower water, the improvement consisting essentially of adding to said shower water a relatively low molecular weight organic anionic polymer selected from the group consisting of: homopolymers of acrylic acid, copolymers of methacrylic acid and polyethylene glycol allyl ether, homopolymers of methacrylic acid, copolymers of acrylic acid and polyethylene glycol allyl ether, and copolymers of acrylic acid and 1-allyloxy-2-hyroxypropane sulfonic acid, said polymer being added in an amount from about 10 to 1500 parts per million parts of said shower water.

15. The process of claim 14 wherein said polymer and said surfactant are added to said shower water in an amount from about 100 to 300 parts per million parts of said shower water.

* * * * *